US006409313B1

(12) United States Patent
Newcombe

(10) Patent No.: US 6,409,313 B1
(45) Date of Patent: Jun. 25, 2002

(54) APPLICATION OF DIFFERENTIAL VOLTAGE TO A PRINTHEAD

(75) Inventor: Guy Charles Fernley Newcombe, Cambridge (GB)

(73) Assignee: Tonejet Corporation Pty Ltd., Eastwood ( * ) Notice: Subject to any disclaimer, the term of this patent is extended or adjusted under 35 U.S.C. 154(b) by 0 days.

(21) Appl. No.: 09/380,188

(22) PCT Filed: Mar. 24, 1998

(86) PCT No.: PCT/GB98/00888

§ 371 (c)(1),
(2), (4) Date: Aug. 26, 1999

(87) PCT Pub. No.: WO98/42515

PCT Pub. Date: Oct. 1, 1998

(30) Foreign Application Priority Data

Mar. 24, 1997 (GB) ..... 9706069

(51) Int. Cl.[7] ..... B41J 2/06
(52) U.S. Cl. ..... 347/55
(58) Field of Search ..... 347/55, 54, 20, 347/57, 71, 44, 151, 120, 141, 103, 123, 111, 159, 127, 128, 131, 125, 158; 399/271, 290, 292, 293, 294, 295

(56) References Cited

U.S. PATENT DOCUMENTS 4,794,463 A 12/1988 Blanchard ..... 358/296
5,619,234 A * 4/1997 Nagato et al. ..... 347/55
5,742,412 A * 4/1998 Minemoto et al. ..... 347/20
5,790,142 A * 8/1998 Uchinami et al. ..... 347/57
5,801,730 A * 9/1998 Shima et al. ..... 347/55
5,872,580 A * 2/1999 Ochi et al. ..... 347/71
5,874,972 A * 2/1999 Suetsugu et al. ..... 347/55

FOREIGN PATENT DOCUMENTS

| | | | |
|---|---|---|---|
| EP | 0 198 661 | 10/1986 | ..... B41J/2/06 |
| EP | 0565280 A2 * | 10/1993 | ..... B41J/2/16 |
| EP | 0703080 A2 * | 3/1996 | ..... B41J/2/06 |
| EP | 0 750 989 | 1/1997 | ..... B41J/2/06 |
| EP | 0 761 443 | 3/1997 | ..... B41J/2/06 |
| EP | 0 786 344 | 7/1997 | ..... B41J/2/06 |
| EP | 0 813 965 | 12/1997 | ..... B41J/2/06 |
| WO | 97/27056 | 7/1997 | ..... B41J/2/06 |

* cited by examiner

*Primary Examiner*—Raquel Yvette Gordon
(74) *Attorney, Agent, or Firm*—Dykema Gossett PLLC

(57) ABSTRACT

The invention relates to a method of ejecting material from a liquid within a chamber (5), comprising: controlling the application of first voltage pulses (A) to a first electrode (9) associated with the chamber and second voltage pulses (B) to a second electrode (19) associated with the chamber, such that when a voltage pulse (A) is applied to the first electrode (9) a voltage pulse (B), inverted with respect to the pulse (A) applied to the ejection electrode (9), is applied to the second electrode (19).

8 Claims, 7 Drawing Sheets

APPLICATION OF DIFFERENTIAL VOLTAGE TO A PRINTHEAD

BACKGROUND OF THE INVENTION

The present invention. relates to a method and apparatus for ejecting material from a liquid. The invention employs technology the same as or similar to that described in WO97/27057, and, more particularly, it relates to the application of a differential voltage to the electrodes of a printhead.

In order to control the ejection of material the electrical potential gradient at an ejection location needs to be varied from below a threshold to above a threshold. This has been achieved by applying a voltage pulse to an ejection electrode. However, there are limitations in the availability of compact electronic drive circuits which are able to provide the required voltage pulses, and this presents particular problems in small printheads. Also, in printheads containing an array of ejection locations, capacitive coupling between proximate ejection locations can adversely effect ejection. This cross-talk can be reduced if lower voltages are used, and it is therefore desirable to use the smallest possible voltages to cause ejection.

EP-A-0 761 443 discloses an array printer having multiple ink outlets in which matrix addressing of the ink outlets is achieved by applying a voltage to individual ejection electrodes and an inverse voltage to common control electrodes in order to achieve ejection from specific ink outlets.

SUMMARY OF THE INVENTION

According to the present invention there is provided a method ejecting material from a liquid within a chamber of a multi-chamber ejection device having respective ejection and secondary electrodes associated with each chamber, the method comprising:

controlling the application of first voltage pulses to a respective ejection electrode associated with the chamber and second voltage pulses to a respective secondary electrode associated with the chamber, such that when a voltage pulse is applied to the ejection electrode a voltage pulse, inverted with respect to the pulse applied to the ejection electrode, is applied to the secondary electrode.

It should be understood that, in the context of this invention, the word "inverted" is intended to define voltage pulses which may have either opposite signs, or voltage pulses with voltages that rise and fall in an opposing manner.

It should also be understood that, although there is no limitation to the pulses being of equal and opposite magnitude, it is preferable that the moduli of the change in voltage of the voltage pulses are equal.

According to the present invention there is also provided apparatus for ejecting material from a liquid, comprising a plurality of chambers for containing the liquid; respective ejection and secondary electrodes associated with each chamber;

control means for applying first voltage pulses to a respective ejection electrode associated with a chamber and second voltage pulses to a respective secondary electrode associated with the chamber;

the control means controlling the first and second voltages such that, when a voltage pulse is applied to the ejection electrode, a voltage pulse, inverted with respect to the pulse applied to the ejection electrode, is applied to the secondary electrode.

Voltage pulses may be applied to multiple ejection electrodes and multiple secondary electrodes.

BRIEF DESCRIPTION OF THE DRAWINGS

A number of embodiments of the invention will now be described with reference to the accompanying drawings, in which.

DESCRIPTION OF THE PREFERRED EMBODIMENTS

Figure 1:
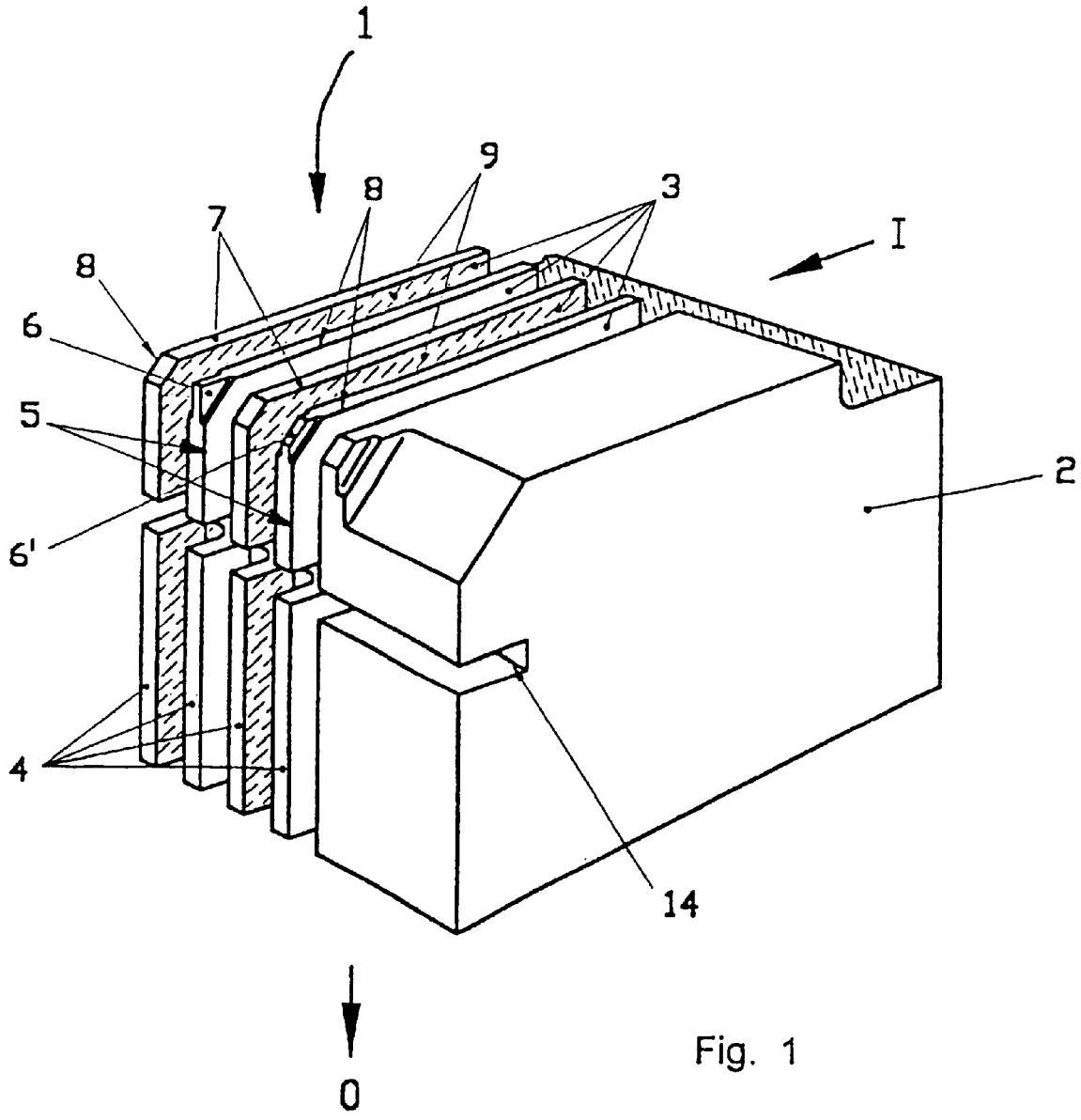
FIG. 1 is a partial perspective view of a portion of a printhead incorporating ejection apparatus according to the present invention.

Referring to FIG. 1, part of an array-type printhead 1, as described in our earlier application PCT/GB97/00186, is illustrated, the printhead comprising a body 2 of a dielectric material such as a synthetic plastics material or a ceramic. A series of grooves 3 are machined in the body 2, leaving interposing plate-like lands 4. The grooves 3 are each provided with a ink inlet and ink outlet (not shown, but indicated by arrows I & O) disposed at opposite ends of the grooves 3 so that fluid ink carrying a material which is to be ejected (as described in our earlier application, WO97/27057) can be passed into the grooves and depleted fluid passed out.

Each pair of adjacent grooves 3 define a cell 5, the plate-like land or separator 4 between the pairs of grooves 3 defining (for all but the cells immediately adjacent the ends of the array) an ejection location for the material and having an ejection upstand 6. In the drawing two cells 5 are shown, the left-hand cell 5 having an ejection upstand 6 which is of generally triangular shape and the right-hand cell 5 having a truncated upstand 6'. The cells 5 are separated by a cell separator 7 formed by one of the plate-like lands 4 and the corner of each separator 7 is shaped or chamfered as shown so as to provide a surface 8 to allow the ejection upstand 6 to project outwardly of the cell beyond the exterior of the cell as defined by the chamfered surfaces 8. The truncated upstand 6' is used in the right-hand, end cell 5 of the array (and similarly in the end cell at the other end—not shown) to reduce end effects resulting from the electric fields which in turn result from voltages applied to ejection electrodes 9 provided as metallised surfaces on the faces of the plate-like lands 4 facing the upstands 6,6' (ie. the inner faces of each cell separator). Although the end cells are not used for ejection, the truncated upstand 6' acts to pin the liquid meniscus which in turn reduces end effects during operation, which might otherwise distort the ejection from the adjacent cell. The electrode 9 in the end cells is held at a suitable bias voltage which may be the same as a bias voltage applied to the ejection electrodes 9 in the operative cells as described in our earlier applications mentioned above. As can be seen from FIG. 3, the ejection electrodes 9 extend over the side faces of the lands 4 and the bottom surfaces 10 of the grooves 3. The precise extent of the ejection electrodes 9 will depend upon the particular design and purpose of the printer. An isolation groove 14, to provide a measure of protection against electrical shorting between adjacent cells 5, is provided in some cases, if required.

Figure 2:
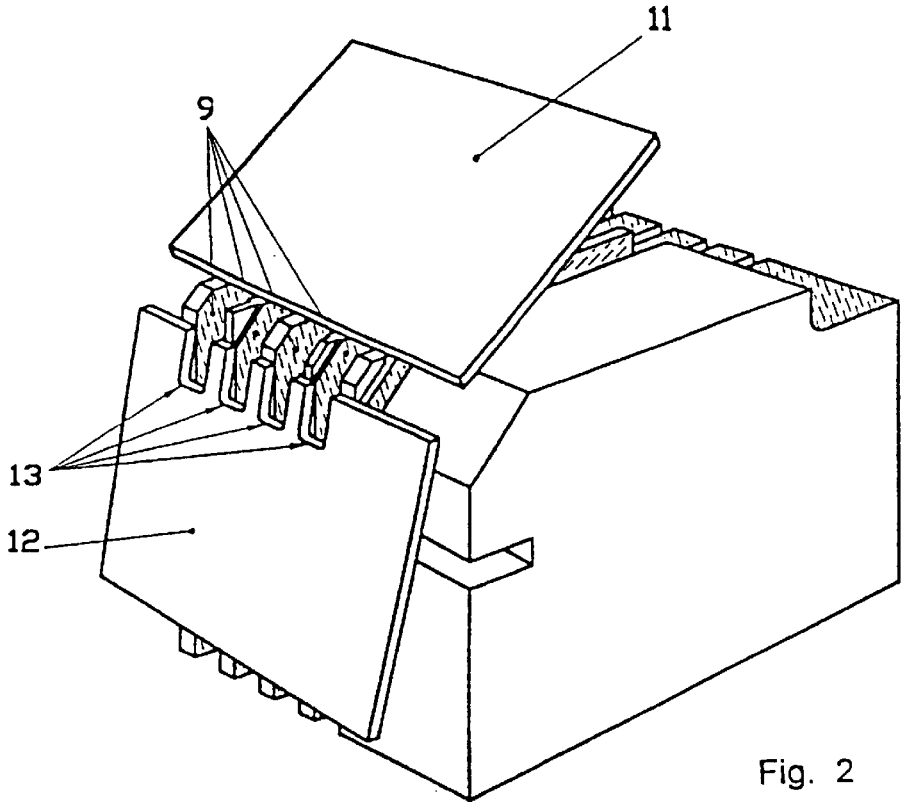
FIG. 2 is a view similar to FIG. 1 showing further and alternative features of the ejection apparatus.

FIG. 2 illustrates two alternative forms for side covers of the printer, the first being a simple straight-edged cover 11 which closes the sides of the grooves 3 along the straight line as indicated in the top part of the figure. A second type of cover 12 is shown on the lower part of the figure, the cover still closing the grooves 3 but having a series of edge slots 13 which are aligned with the grooves. This type of cover construction may be used to enhance definition of the position of the fluid meniscus which is formed in use and the covers, of whatever form, can be used to provide surfaces onto which the ejection electrode and/or secondary or additional electrodes can be formed to enhance the ejection process.

FIG. 2 also illustrates an alternative form of the ejection electrode 9, which comprises an additional metallised surface on the face of the land 4 which supports the upstand 6,6'. This may help with charge injection and may improve the forward component of the electric field.

Figure 3:
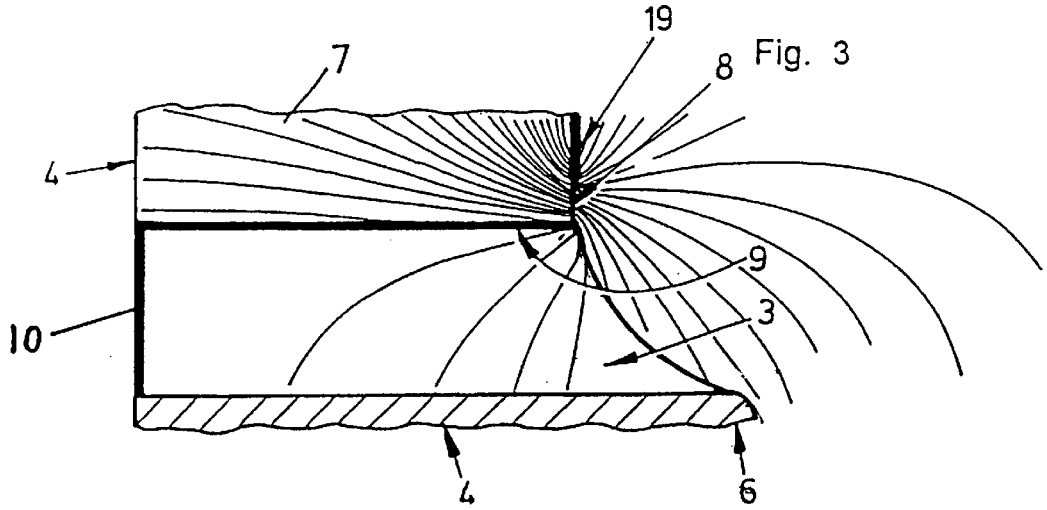
FIG. 3 is a partial sectional view through a cell of FIG. 1.

FIG. 3 illustrates a partial sectional view through one side of the one of the cells 5 of FIG. 1, with a secondary electrode 19 being shown located on the chamfered face 8 on the cell separator lands 4 and therefore disposed substantially alongside the ejection upstand. In a further embodiment (not shown) the secondary electrode may be formed, at least in part, on the face of the cell separator land 4 (and thus rearwardly of the ejection upstand), with land 4 (and thus rearwardly of the ejection upstand), with the ejection electrode also on the face, but separated therefrom.

Figure 4:
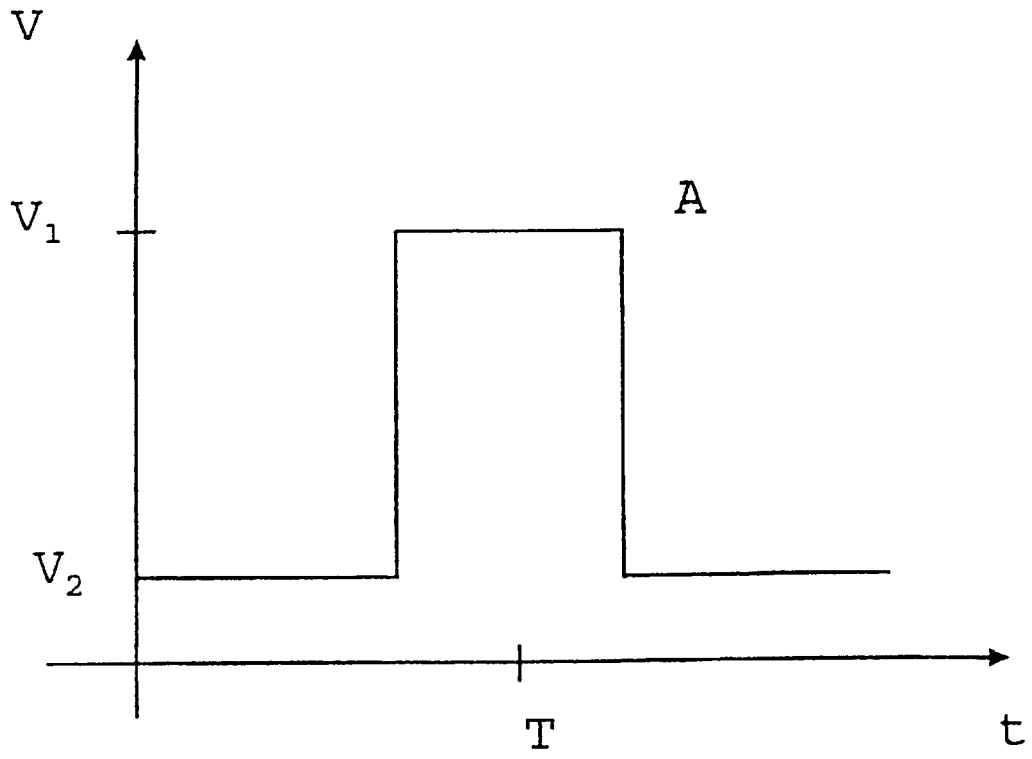
FIG. 4 is a graphical illustration of voltages that may be applied to the one electrode.
Figure 5:
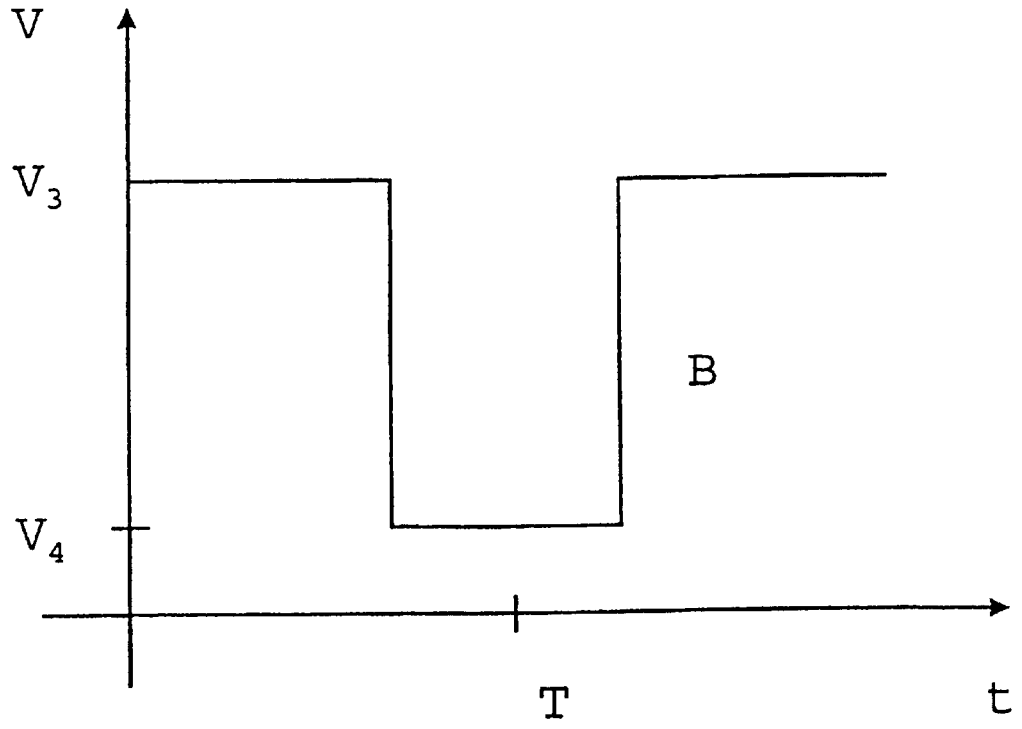
FIG. 5 is a graphical illustration of voltages that may be applied to the another electrode.

Referring now to FIGS. 4 and 5 voltage pulses A and B, for example, are applied to the electrodes 9 and 19 respectively. The electrical potential between the electrodes 9,19 must change sufficiently for ejection to be achieved. When the voltage pulses are applied, the difference in the voltages $V_1$ and $V_4$ applied to the electrodes 9 and 19 is large and can be sufficient to cause ejection. However, it can be appreciated that lower voltage changes may be applied to each of the electrodes 9,19 than would need to be applied to the ejection electrode 9, if the ejection electrode 9 was the only electrode used to facilitate ejection.

For example, the initial voltage $V_2$, $V_3$ applied to each of the electrodes 9,19 may be 800V, and when ejection is desired the voltage on the ejection electrode 9 may be increased to $V_1$=1150V and the voltage on the secondary electrode 19 may be decreased to $V_4$=450V. Thus a localised net effect is a change of 700V at the ejection location, but the largest actual voltage change applied is only 350V. However, if the ejection electrode 9 was the only electrode used to facilitate ejection a voltage change of a full 700V would need to be applied to it. This is disadvantageous as it results, for example, in a less localised electric field causing capacitive coupling between ejection locations.

Alternatively, if both electrodes are in contact with the ink and the secondary electrode 19 is otherwise insulated, the voltages applied to the electrodes initially may be $V_2$=750V to the ejection electrode 9 and $V_3$=1100V to the secondary electrode 19. When ejection is desired the voltages are switched, i.e. the voltage on the ejection electrode 9 is increased to $V_1$=1100V and the voltage on a secondary electrode 19 is decreased to $V_4$=750V. This embodiment relies on particles in the ink becoming charged creating a mean voltage level such that when the voltages on the electrodes are switched the net effect on the particles to be ejected is that they see twice the potential.

So, in both examples, the actual voltage changes used to cause ejection are only 350V, which is half the voltage change that would need to be applied to only the ejection electrode 9 if that were the only voltage to be changed. It can also be appreciated that only fairly simple circuitry is required to apply pulses of this nature.

Figure 6:
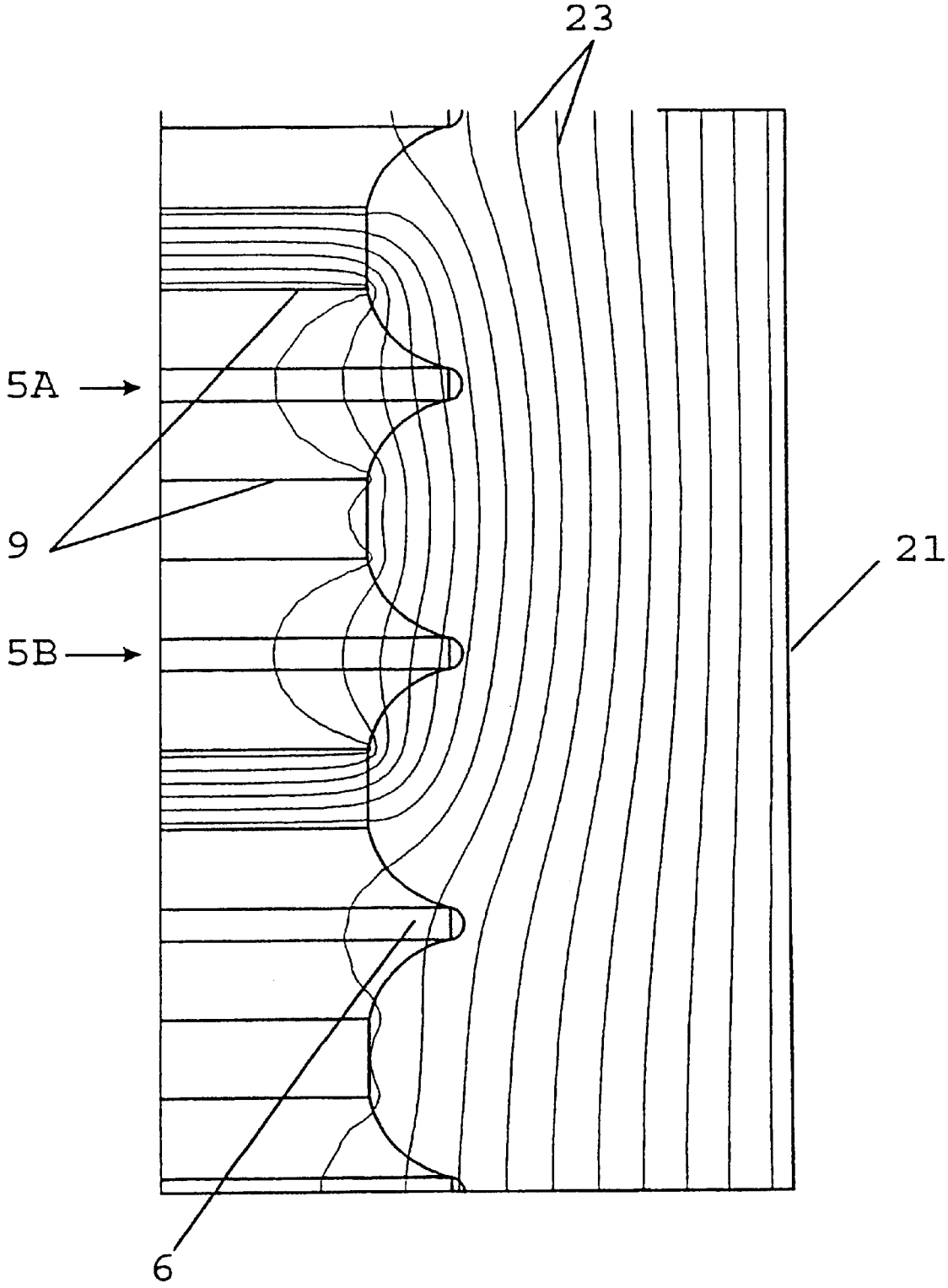
FIG. 6 is a plan view of an ejection apparatus similar to that illustrated in FIG. 1.

In the printhead illustrated in FIG. 6, lines of equipotential 23 illustrate the electric field generated when ejection is caused from two neighbouring cells 5A and 5B by applying an electric pulse of 600V to the primary electrodes 9 in those cells only. It can be seen from FIG. 7, which is a close up view of the cell 5B, that the electric field illustrated by the lines of equipotential 23 is not orthogonal to the desired droplet trajectory, which is the shortest path between the cell 5B and the substrate 21.

Figure 7:
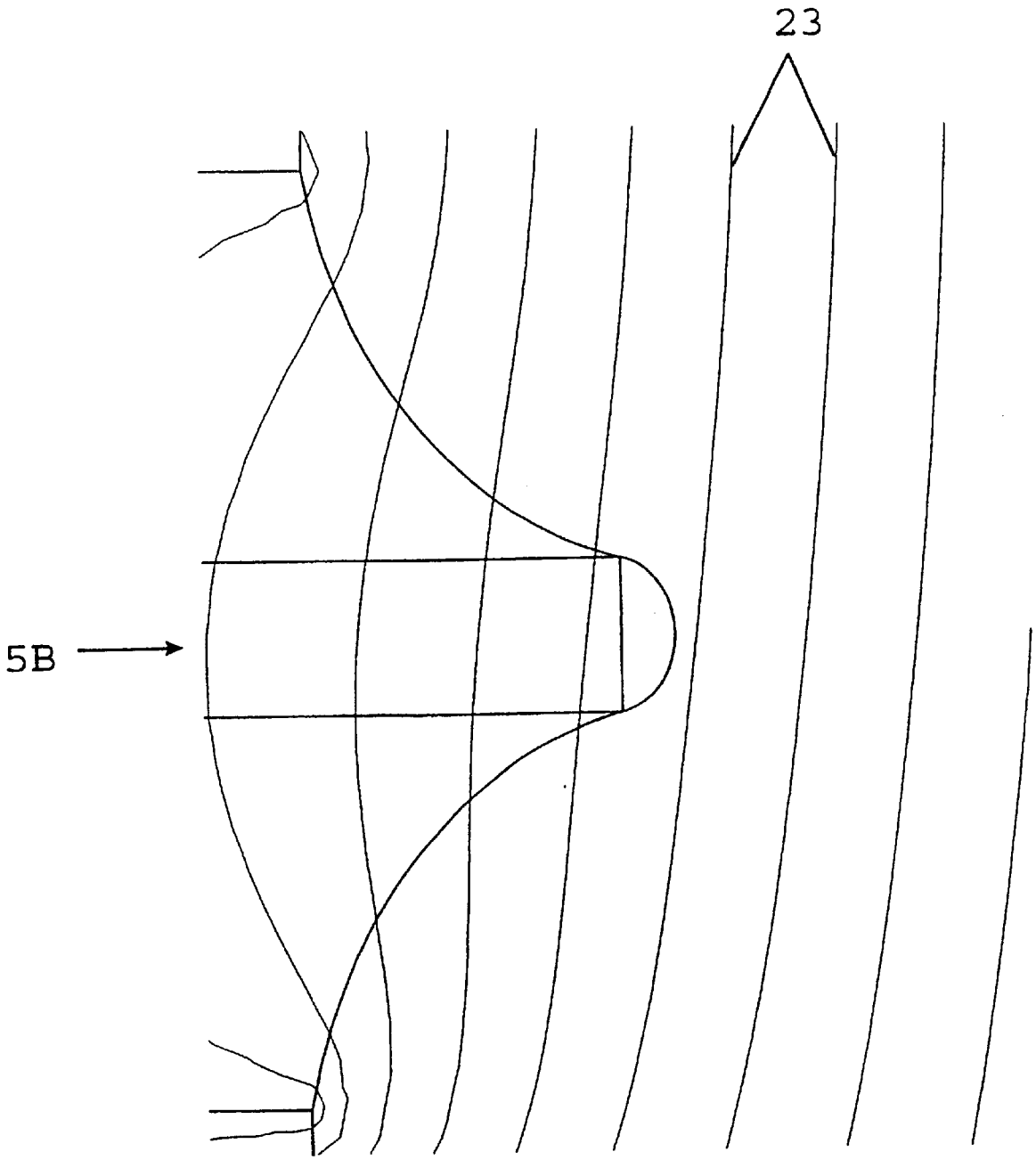
FIG. 7 is a close up plan view of a cell of the ejection apparatus of FIG. 6.

It will be appreciated that the resulting asymmetry in the field, as shown in FIG. 7, will act to drive the drops off the desired trajectory to one side and it has been found in this example that the field at the ejection location makes an angle of about 6° with the desired droplet trajectory. Such a deviation results in a placement error of approximately 100 microns at a head-substrate gap of 1.0 mm.

Figure 8:
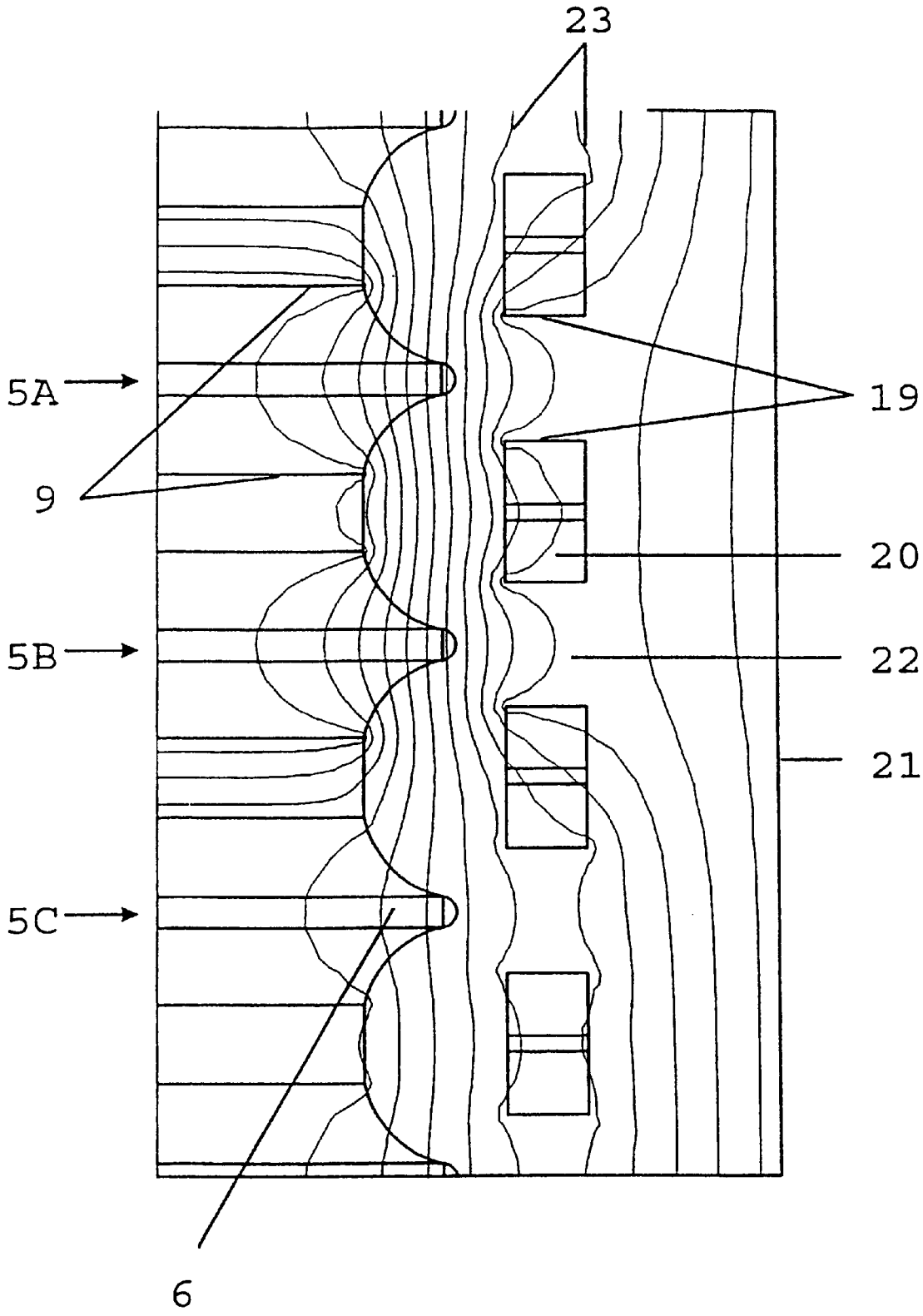
FIG. 8 is a plan view of an alternate ejection apparatus showing a modified electric field.

In another example, as shown in FIG. 8, pairs of secondary electrodes 19 are provided on a support 20 lying between the ejection electrodes 9 and a substrate 21. The electrodes 19 are, in this example, generally planar and lie on faces of the support 20 parallel to the ejection electrodes 9. Secondary electrodes 19 transverse to this plane or with any other shape or orientation can work equally well. Between the secondary electrodes 19 of each pair is a hole 22, each of which is disposed directly in front of an ejection upstand 6 of a corresponding cell 5A,5B,5C. The holes 22 may (as shown) take the form of slits or notches, and it can be appreciated that the support 20 is an integral unit with the illustrated sections joined together out of the plane of the figure. The holes 22 may alternatively be circular and there may then be a single secondary electrode 19 around the circumference of each hole. The secondary electrodes 19are provided on the sides or around the periphery of the holes 22 such that they are proximate to ejected material passing through the holes 22.

In operation, a voltage pulse is applied to an ejection electrode 9 and an inverted pulse is applied, in this example, to a pair secondary electrodes 19 of a corresponding hole 22. In this example the pulse and inverted pulse are applied simultaneously. The benefits of this approach become clear when the effects of ejection in a cell 5A on a neighbouring cell 5B is considered.

Figure 9:
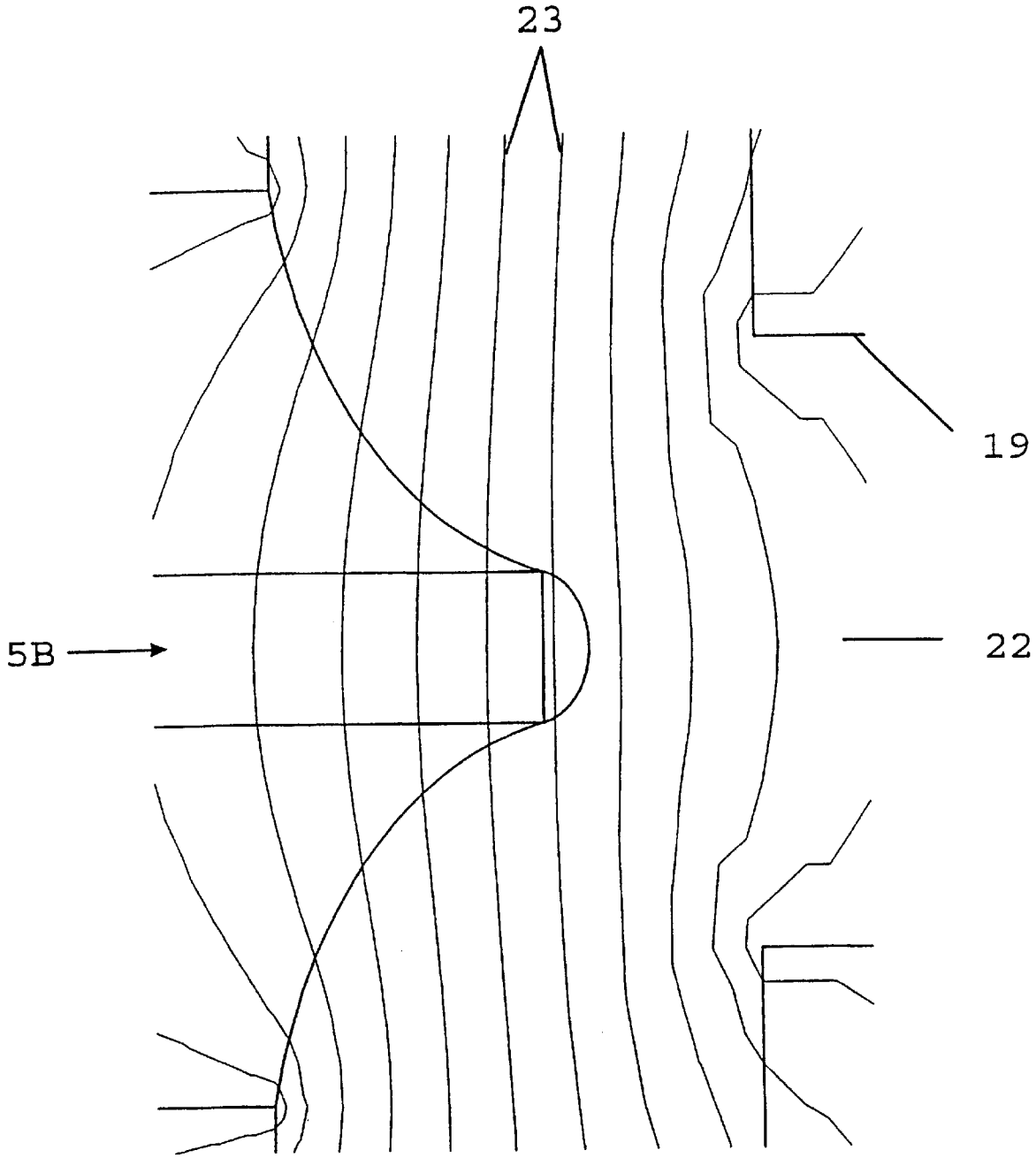
FIG. 9 is a close up plan view of a cell of the alternate ejection apparatus showing a modified electric field.

FIGS. 8 and 9 show the field pattern when the primary electrode 9 is driven by a +300V pulse and the corresponding secondary electrodes 19 are driven by a synchronised −300V pulse. While the field is not everywhere symmetrical, the field at the ejection tip now lies parallel to the desired droplet trajectory. Thus, unlike the situation in which there are no secondary electrodes 19 or they are not charged, the field generated by a combined positive pulse from the primary electrode 9 and a simultaneous inverted pulse from the secondary electrodes 19 does not result in significant distortion of the field at neighbouring ejection cells 5 and such distortion that there is is not asymmetrical. With such an arrangement both the dot size and dot position become largely independent of the pattern in which neighbouring electrodes are driven.

In such an arrangement it is possible to drive all the cells 5 synchronously with a high duty cycle whilst maintaining a high image quality. This is particularly advantageous for high speed, high quality printing.

It has been found that for optimum performance the relative magnitude of the voltage pulse applied to the ejection electrode 9 and the voltage pulse applied to the secondary electrodes 19 should be varied dependant on the precise geometry of the apparatus. For a given geometry pulse magnitudes are varied so as to ensure that the field in each driven cell is parallel to the desired droplet trajectory, as illustrated in FIG. 9.

A similar arrangement can also enable use of matrix addressing. Here ejection is obtained only when a pulse is applied to the ejection electrode 9 and an inverted pulse is applied to the secondary electrode 19, but one or the other pulse may be applied to groups of cells 5, without causing ejection. Such schemes permit a reduction in the total number of electronic drive devices required to drive a multi-channel apparatus.

What is claimed is:

1. A method of ejecting material from a liquid within a chamber of a multi-chamber ejection device having respective ejection and second electrodes associated with each said chamber, the method comprising:

insulating the second electrode from the ejection electrode and the liquid;

applying first voltage pulses (A) and second voltage pulses (B) to the ejection electrode and the second electrode respectively; and controlling the first voltage pulses (A) to the respective ejection electrode associated with the chamber and the second voltage pulses (B) to the second electrode associated with the chamber, such that when the first voltage pulses (A) are applied to the ejection electrode, the second voltage pulses (B) applied to the second electrode are inverted with respect to the first voltage pulses.

2. A method according to claim 1, wherein the first voltage pulses (A) are applied to multiple respective ejection electrodes associated with the chamber and the second voltage pulses (B) are applied to multiple respective second electrodes associated with the chamber.

3. An apparatus for ejecting material from a liquid, comprising:

a plurality of chambers for containing the liquid;

a respective ejection electrode and a second electrode associated with each chamber, said second electrode being insulated from the ejection electrode and the liquid;

control means for applying first voltage pulses (A) to the respective ejection electrode associated with a chamber and for applying the second voltage pulses (B) to the respective second electrode associated with the chamber;

the control means controlling the first and second voltage pulses such that, when the first voltage pulses (A) are applied to the ejection electrode, the second voltage pulses (B) are inverted with respect to the first voltage pulses (A).

4. An apparatus according to claim 3, wherein the control means controls the first and second voltage pulses such that a moduli of a change in voltage of the first voltage pulses (A) and a change in voltage of the second voltage pulses (B) are equal.

5. An apparatus according to claim 3, wherein the control means applies the first voltage pulses (A) to multiple respective ejection electrodes associated with the chamber and applies the second voltage pulses (B) to multiple respective second electrodes associated with the chamber.

6. A method of ejecting material from a liquid within a chamber of a multi-chamber ejection device having at least one ejection electrode and at least one second electrode associated with each said chamber comprising the steps of:

insulating the second electrode from the ejection electrode and the liquid; and applying first voltage pulses to the ejection electrode associated with the chamber and applying second voltage pulses to the second electrode associated with the chamber, controlling said first and second voltage pulses such that the first voltage pulses applied to the ejection electrode are inverted with respect to the second voltage pulses applied to the second electrode.

7. An apparatus for ejecting material from a liquid, comprising:

a plurality of chambers for containing the liquid;

at least one ejection electrode and at least one second electrode associated with each of said chambers, said second electrode being insulated from the ejection electrode and the liquid;

means for applying first voltage pulses to the ejection electrode associated with a corresponding one of said chambers and second voltage pulses to the second electrode associated with the corresponding one of said chambers; and control means for controlling the first and second voltage pulses such that the first voltage pulses applied to the ejection electrode is inverted with respect to the second voltage pulses applied to the second electrode.

8. A method of ejecting material from a liquid within a chamber of a multi-chamber ejection device having at least one ejection electrode and at least one second electrode associated with each said chamber comprising the steps of:

insulating the second electrode from the ejection electrode and the liquid;

applying first voltage pulses to the ejection electrode associated with the chamber and applying second voltage pulses to the second electrode associated with the chamber, controlling said first and second voltage pulses such that the first voltage pulses applied to the ejection electrode are inverted with respect to the second voltage pulses applied to the second electrode; and operating the ejection electrode relative to the second electrode such that an electric field is produced in the chamber without a substantial heating current flowing through the liquid.

* * * * *